United States Patent [19]

Parr et al.

[11] Patent Number: 4,699,729

[45] Date of Patent: Oct. 13, 1987

[54] PROCESS FOR MANUFACTURING BENTONITE-CONTAINING PARTICULATE FABRIC SOFTENING DETERGENT COMPOSITION

[75] Inventors: Richard S. Parr, East Brunswick; Pallassana N. Ramachandran, Robinsville; Seymour Grey, Somerset; Martin D. Reinish, Emerson, all of N.J.

[73] Assignee: Colgate Palmolive Co., New York, N.Y.

[21] Appl. No.: 682,917

[22] Filed: Dec. 18, 1984

Related U.S. Application Data

[63] Continuation of Ser. No. 411,295, Aug. 25, 1982, Pat. No. 4,526,702.

[51] Int. Cl.[4] ..... C11D 17/06

[52] U.S. Cl. ..... 252/174.25; 252/8.6; 252/135; 252/140; 252/539; 261/117; 23/313 AS

[58] Field of Search ..... 252/174.25, 8.6, 135, 252/539, 140; 261/117; 23/313 AS

[56] References Cited

U.S. PATENT DOCUMENTS

| | | | |
|---|---|---|---|
| 3,609,088 | 9/1971 | Sumner | 23/313 AS |
| 3,966,629 | 6/1976 | Dumbrell | 252/140 |
| 4,419,250 | 12/1983 | Allen et al. | 252/140 |
| 4,488,972 | 12/1984 | Weinstein | 252/174.25 |

*Primary Examiner*—Paul Lieberman
*Assistant Examiner*—Hoa Van Le
*Attorney, Agent, or Firm*—B. Lieberman; M. M. Grill; H. S. Sylvester

[57] ABSTRACT

A fabric softening particulate synthetic organic detergent composition is made by mixing together a minor proportion of a finely divided bentonite powder and a major proportion of larger sized built synthetic organic detergent composition particles, spraying onto the surfaces of the moving mixture a dilute sodium silicate solution so that a small proportion of sodium silicate and a larger proportion of moisture are deposited on the mixing materials, and continuing mixing of the materials after cessation of the spraying of the silicate solution onto them.

6 Claims, 2 Drawing Figures

Figure 1:
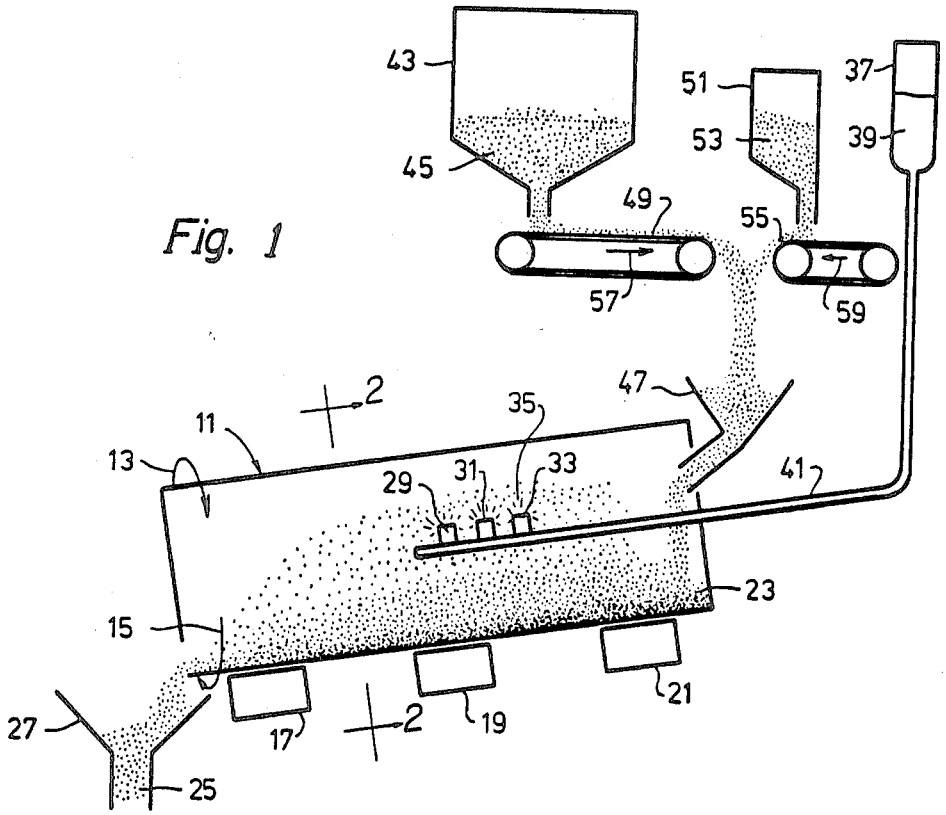

PROCESS FOR MANUFACTURING BENTONITE-CONTAINING PARTICULATE FABRIC SOFTENING DETERGENT COMPOSITION

This application is a continuation of application Ser. No. 411,295, filed Aug. 25, 1982, which issued as U.S. Pat. No. 4,526,702 on Jul. 2, 1985.

This invention relates to a process for manufacturing particulate fabric softening detergent compositions. More particularly, it relates to a process of agglomerating a finely divided water insoluble softening agent onto the surfaces of larger sized detergent composition particles.

In accordance with this invention a process for manufacturing a fabric softening particulate synthetic organic detergent composition comprises mixing together a minor proportion of a finely divided bentonite powder and a major proportion of larger sized detergent composition particles, spraying onto the surfaces of the mixture, while it is in motion, with new surfaces of the mixing materials being continuously presented to the spray, a minor proportion of an aqueous sodium silicate solution at a concentration in the range of 2 to 8% in such quantity that the spray deposits from about 0.1 to 0.4% of sodium silicate and about 2 to 8% of moisture on the mixture, continuing mixing after application of the aqueous sodium silicate solution, and removing agglomerated particulate detergent with bentonite powder held to the surfaces thereof. Preferably, the bentonite employed is of particle sizes such that substantially all of it passes through a No. 200 sieve, U.S. Sieve Series (more preferably, all of it passes through a No. 325 sieve), the detergent composition particles are spray dried particles of a built synthetic organic detergent composition of particle sizes in the range of Nos. 8 to 100 sieves (more preferably Nos. 10 to 60 sieves), the sodium silicate is of $Na_2O:SiO_2$ ratio of about 1:2.4, the droplets of the sodium silicate spray are of diameters no greater than one millimeter, (more preferably in the range of 0.1 to 0.5 mm.), and the process takes place in a rotary drum type mixer, such as one which extends longitudinally at an angle of from about 2° to 15° the horizontal, with the initial mixing, the spraying-agglomerating and the subsequent mixing taking place sequentially in an upstream third, a middle third, and a downstream third of the mixer, respectively.

Figure 2:
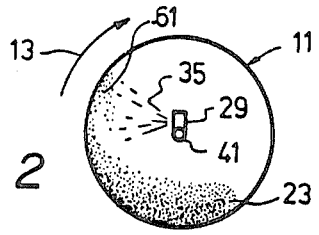

The process of this invention will be readily understood from the present specification, taken in conjunction with the drawing, in which:

FIG. 1 is a schematic central longitudinal sectional elevational view of a rotary drum type mixer, with other equipment utilized in the practice of the process of this invention; and FIG. 2 is a transverse sectional view of said rotary drum along plane 2—2, showing the spraying of silicate solution onto the tumbling particles of detergent composition and bentonite.

In FIG. 1 an open ended, inclined, cylindrical rotary drum 11 is shown rotating about an axis which is at a relatively small acute angle to the horizontal, with such rotation being in the direction shown by arrows 13 and 15. Drum 11 rests on rollers 17, 19 and 21, which rotate in the opposite direction from the drum (counterclockwise, rather than clockwise, viewed from the left), causing it to turn as indicated. Rotary drum 11 contains a mixture 23 of spray dried built synthetic organic detergent beads and bentonite powder which is agglomerated in the drum into fabric softening detergent composition beads or particles, due to the spraying of a dilute sodium silicate solution onto the particles while the mixture is in motion. Final agglomerated softening detergent particles 25 are removed from drum 11 via shute 27. Spray nozzles 29, 31 and 33 are employed to produce essentially conical sprays of silicate solution, such as those represented by numeral 35, which impinge on the moving mixture of detergent beads and bentonite powder and promote agglomeration of the powder onto the surfaces of the beads although in some instances agglomerates may also be formed of bentonite alone or detergent beads alone (the latter being less common). In the rotating drum, the right or upstream third or similar part is a mixing zone wherein the bentonite and detergent beads are dry mixed, the middle portion is a spraying and agglomerating zone, and the downstream third or so is one wherein spraying is not effected, the moistened particles and agglomerates are "finished" to relatively free flowing product, and the desired form and character of the agglomerate results.

The foregoing description relates primarily to a rotary drum which is a preferred embodiment of the apparatus employed in the practice of this invention although other equivalent or substitute means may also be utilized. In addition to the rotary drum, supply means for adding the various final product constituents are provided. Thus, supply tank 37 contains sodium silicate solution 39 (as distinguished from spray 35), which is delivered to spray nozzles 29, 31 and 33 through line 41. Hopper bin 43 contains detergent beads 45 which are delivered to hopper 47 by means of delivery belt 49. Similarly, hopper bin 51 contains bentonite powder 53 which is delivered to hopper 47 by delivery belt 55. Arrows 57 and 59 indicate the directions of such belt movements, respectively.

In FIG. 2 the mixture 23 in drum 11 is shown being carried up the left wall of the drum, which is rotating in the direction of arrow 13. As mix 23 falls downwardly along the face 61 of the upper wall thereof spray 35 of aqueous silicate solution, sprayed in conical patterns from nozzle 29 and other hidden nozzles 31 and 33, impinges on the moving mixture, moistens the surfaces of the nucleus detergent composition beads and promotes agglomeration of the bentonite with the beads, with the more finely divided bentonite powder usually adhering to the surfaces of the larger detergent composition particles. Thus, constantly renewing faces or curtains of falling particles are contacted by the sprays and substantially uniform moistening and application of the silicate to the particles is obtained, which leads to production of a more uniform and better agglomerated product.

The detergent composition particles which are to be agglomerated with a more finely divided bentonite powder on the surfaces thereof, may be of any suitable composition and can be produced in any of various ways. However, for best agglomeration and for improved appearance of the end product it will be preferred that they be spray dried particles of sizes within the Nos. 8 to 100, more preferably 8 or 10 to 60 and most preferably 10 to 40 or 60 sieve size ranges, U.S. Sieve Series. Normally such products will comprise a synthetic organic detergent which will be either an anionic or nonionic detergent, a builder for the detergent, adjuvant(s) and moisture. Among the various anionic detergents that may be employed, usually as their sodium salts, those which are most preferred are linear higher alkyl benzene sulfonates, higher alkyl sulfates and higher fatty alcohol polyethoxylate sulfates. Preferably, in the higher alkyl benzene sulfonate the higher alkyl is linear and averages 11 to 15 carbon atoms, e.g., 12 or 13, and is a sodium salt. However, other alkyl benzene sulfonates, of 10 or 12 to 18 carbon atoms in the alkyl group, may also be employed. The alkyl sulfate is preferably a higher fatty alkyl sulfate of 10 to 18 carbon atoms, preferably 12 to 16 carbon atoms, e.g., 12, and is also employed as the sodium salt. The higher alkyl ethoxamer sulfates will similarly be of 10 or 12 to 18 carbon atoms, e.g., 12, in the higher alkyl, which will preferably be a fatty alkyl, and the ethoxy content will normally be from 3 to 30 ethoxy groups per mol, preferably 3 or 5 to 20. Again, the sodium salts are preferred. Thus, it will be seen that the alkyls are preferably linear or fatty higher alkyls of 10 to 18 carbon atoms, the cation is preferably sodium, and when a polyethoxy chain is present the sulfate is at the end thereof. Other useful anionic detergents include the higher olefin sulfonates and paraffin sulfonates, e.g., the sodium salts wherein the olefin or paraffin groups are of 10 to 18 carbon atoms. Specific examples of the preferred detergents are sodium dodecyl benzene sulfonate, sodium tallow alcohol polyethoxy (3 EtO) sulfate, and sodium hydrogenated tallow alcohol sulfate. In addition to the preferred anionic detergents mentioned, others of this well-known group may also be present, especially in only minor proportions with respect to those previously described. Also, mixtures thereof may be employed and in some cases such mixtures can be superior to single detergents. The various anionic detergents are well known in the art and are described at length at pages 25 to 138 of the text *Surface Active Agents and Detergents,* Vol. II, by Schwartz, Perry and Berch, published in 1958 by Interscience Publishers, Inc.

Although various nonionic detergents of satisfactory physical characteristics may be utilized, including condensation products of ethylene oxide and propylene oxide with each other and with hydroxyl-containing bases, such as nonyl phenol and Oxo-type alcohols, it is highly preferable that the nonionic detergent, if present, be a condensation product of ethylene oxide and higher fatty alcohol. In such products the higher fatty alcohol is of 10 to 20 carbon atoms, preferably 12 to 16 carbon atoms, and the nonionic detergent contains from about 3 to 20 or 30 ethylene oxide groups per mol, preferably from 6 to 12. Most preferably, the nonionic detergent will be one in which the higher fatty alcohol is of about 12 to 13 or 15 carbon atoms and which contains from 6 to 7 or 11 mols of ethylene oxide. Such detergents are made by Shell Chemical Company and are available under the trade names Neodol®23-6.5 and 25-7. Among their specially attractive properties, in addition to good detergency with respect to oily marks on goods to be washed, is a comparatively low melting point, which yet is appreciably above room temperature, so that they may be sprayed onto base beads [which contain builder(s) but no detergent(s)] as a liquid which solidifies. When nonionic detergents are utilized and are applied to detergent beads as a spray, such spray may be exclusively to base beads before surface coating them with bentonite or part or all of the nonionic detergent may be spray dried with the builder salt and stable adjuvants. Alternatively, and sometimes (rarely) preferably, the nonionic detergent may be sprayed onto the agglomerated bentonite-base beads or onto a mixture of such beads with non-bentonite-containing product.

The water soluble builder or mixture of builders employed may be one or more of the conventional materials that have been used as builders or suggested for such purpose. These include inorganic and organic builders, and mixtures thereof. Among the inorganic builders those of preference are the various phosphates, preferably polyphosphates, e.g., tripolyphosphates and pyrophosphates, such as pentasodium tripolyphosphate and tetrasodium pyrophosphate. Trisodium nitrilotriacetate (NTA), preferably employed as the mononhydrate, and other nitrilotriacetates, such as disodium nitrilotriacetate, are preferred organic builder salts. Sodium tripolyphosphate, sodium pyrophosphate and NTA may be utilized in hydrated or anhydrous forms. Other water soluble builders that are considered to be effective include the various other inorganic and organic phosphates, carbonates, bicarbonates, borates, e.g., borax, citrates, gluconates, EDTA and iminodiacetates. Preferably the various water soluble builders will be in the forms of their alkali metal salts, either the sodium or potassium salts, or a mixture thereof, but sodium salts are normally more preferred. The silicates, preferably sodium silicates of $Na_2O:SiO_2$ ratio within the range of 1:1.6 to 1:3.2, preferably 1:2 to 1:3 or 1:2.6, e.g., 1:2.35 or 1:2.4, also serve as water soluble builder salts and aid greatly in agglomeration. The content of silicate in the product will normally not exceed 15%, with the range of 5 to 15% being feasible, preferably 3 to 7%, when zeolite is not present and such content will often be limited to 5%, e.g., 0 to 2%, in the presence of zeolite. Also, only small proportions of silicate will be employed as a binder to hold the bentonite to the detergent or detergent base particles, so its total content in the product is not changed greatly due to its role in facilitating agglomeration. In some cases it may be desirable to post-add free flowing sodium silicate, such as hydrated sodium silicate particles. In addition to the water soluble builders, water insoluble builders, such as the zeolites, especially zeolite A, preferably hydrated, e.g., containing 20% water, may be substituted, preferably only partially.

The bentonite employed is a colloidal clay (aluminum silicate) containing montmorillonite. The type of bentonite clay which is most useful in making the invented base beads is that which is known as sodium bentonite (or Wyoming or western bentonite), which is normally a light to cream-colored or tannish impalpable powder which, in water, forms a colloidal suspension having strongly thixotropic properties. In water the swelling capacity of such clay will usually be in a range of 3 to 15 or 20 ml./gram, preferably 7 to 15 ml./g., and its viscosity, at a 6% concentration in water, will usually be in the range of 3 to 30 centipoises, preferably 8 to 30 centipoises. Preferred swelling bentonites of this type are sold under the trade name Mineral Colloid, as industrial bentonites, by Benton Clay Company, an affiliate of Georgia Kaolin Co. These materials which are the same as those formerly sold under the trademark THIXO-JEL, are selectively mined and beneficiated bentonite, and those considered to be most useful are available as Mineral Colloid Nos. 101, etc., corresponding to THIX-O-JELs Nos. 1, 2, 3 and 4. Such materials have pH's (6% concentration in water) in the range of 8 to 9.4, maximum free moisture contents of about 8% and specific gravities of about 2.6, and for the pulverized grade about 85% passes through a 200 mesh U.S. Sieve Series sieve. Beneficiated Wyoming bentonite is preferred as a component of the present compositions but other bentonites including the synthetic bentonites (those made from bentonites having exchangeable calcium and/or magnesium by sodium carbonate treatment) are also useful. Also, the particle size may be lowered so that all of the bentonite passes a No. 325 screen, which is often highly desirable. Although it is preferable to limit maximum free moisture content, as mentioned, it is more important to make certain that the bentonite being employed includes enough free moisture, most of which is considered to be present between adjacent plates of the bentonite, to facilitate quick disintegration of the bentonite and any adjacent materials in the particles when such particles or detergent compositions containing them are brought into contact with water, such as wash water. It has been found that at least about 2%, preferably at least 3% and more preferably, about 4% or more of water should be present in the bentonite initially, before it is admixed with the other bead components in the crutcher, and such proportion should also be present after any drying of the bentonite that might be undertaken. In other words, overdrying to the point where the bentonite loses its "internal" moisture can significantly diminish the utility of the present compositions. When the bentonite moisture content is too low the bentonite does not satisfactorily aid in disintegrating and dispersing the agglomerated beads in the wash water. When the bentonite is of satisfactory moisture content it may exhibit an exchangeable calcium oxide percentage in the range of about 1 to 1.8 and with respect to the magnesium oxide such percentage can be in the range of 0.04 to 0.41. Typical chemical analyses of such materials are from 64.8 to 73.0% of $SiO_2$, 14 to 18% of $Al_2O_3$, 1.6 to 2.7% of MgO, 1.3 to 3.1% of CaO, 2.3 to 3.4% of $Fe_2O_3$, 0.8 to 2.8% of $Na_2O$ and 0.4 to 7.0% of $K_2O$.

Although some adjuvants, such as fluorescent brightener, pigment, e.g., ultramarine blue, titanium dioxide, polyacrylate, and inorganic filler salt, e.g., sodium sulfate, may be added to the crutcher, others, such as perfumes, enzymes, bleaches, some colorants, bactericides, fungicides, and flow promoting agents may often be sprayed onto or otherwise mixed with spray dried detergent compositions, base beads, or with any nonionic detergent to be post-added to such base beads to make a detergent product, and/or independently, so that they will not be adversely affected by the elevated temperatures of the spray drying operation and also so that their presence in the spray dried beads does not inhibit absorption of nonionic detergent, when such is to be post-sprayed onto the beads. However, for stable and normally solid adjuvants, mixing with the starting slurry in the crutcher is often preferable. Additionally the less stable adjuvants may be post-added to the agglomerates made by the invented process.

Of course, water is present in the crutcher to serve as the medium for dispersing the various other bead components, and some water, in both free and hydrate form is in the product. During drying of the beads the initial moisture content thereof, which will be about 25 to 60%, may be lowered to about 5 to 15%, with such moisture content being sufficient so that any bentonite that may be present in the dried beads (normally less than 10% and preferably none is present) contains at least 2% and preferably at least 4% of moisture. It is preferred to employ deionized water, so that the hardness ion contents thereof may be very low and so that metallic ions that can promote decomposition of any organic materials which may be present in the crutcher mix or post-added materials are minimized, but city or tap water may usually be employed instead. Normally the hardness content of such water will be less than about 300 p.p.m., as $CaCO_3$, preferably less than 150 p.p.m.

The proportions of the various components in the base beads and in the spray dried detergent composition beads will be such as to result in their being effective cleaning agents, of acceptable flow properties, bulk density and appearance. Often they will be white and to accomplish this whiter grades of bentonite will preferably be employed or whitening agents, such as equally finely divided titanium dioxide powder, may be incorporated with the bentonite. The $TiO_2$ content or the content of other whitening agent may be whatever is desirable to improve the bentonite color, e.g., 0.2 to 5% of the bentonite. When colored detergent beads are to be produced it is within the invention to utilize a coloring dye or pigment in the crutcher mix so that the spray dried beads (or beads otherwise produced) are appropriately colored.

It has been found that satisfactory detergent composition beads can be made comprising 5 to 35%, preferably 15 to 30% and more preferably 20 to 25% of synthetic organic detergent, preferably anionic detergent, 30 to 90%, preferably 35 to 85% and more preferably 45 to 70% of builder, 0.2 to 40%, preferably 0.5 to 30% and more preferably 1 to 20% of adjuvant(s), including fillers, and 3 to 20%, preferably 4 to 15% and more preferably 5 to 12% of moisture, e.g., 7%. Such beads, which may be made by normal spray drying processes, or by other "equivalent" means, will usually be of characteristic globular or other shape known to result from spray drying, which make ideal nuclei onto which bentonite powder may be agglomerated. They will normally be of bulk densities within the range of 0.2 to 0.7 g./cc., such as 0.3 to 0.5, e.g., 0.35. The particle sizes thereof will normally be in the 8 to 100 range and particles outside such range may be removed by screening or other separating operations. More preferably, the bead sizes will be from No. 8 or 10 to 40 or 60, U.S. Series, and the beads are white or other suitable color.

The proportion of bentonite, by weight, on the surface of the detergent beads on which it is coated, will normally be within the range of 10 to 30%, preferably 15 to 25%, e.g., 20%, of the total product. It is found that the applications of these comparatively large quantities of bentonite do not change the particle sizes of the "base beads" dramatically, although there may be some increase, such as about 5 to 15% in bead diameters. The relatively slight increase in the bead dimensions does not cause objectionable changes in product bulk density or screen sizes and the presence of the bentonite on the bead exteriors appears to help inhibit separations of different sized particles on storage (compared to smoother surfaced, similarly non-tacky beads).

The application of the bentonite to the detergent composition beads (which in some cases may be inorganic builder beads, as when nonionic detergent is to be post-added) is effected in a rotary drum type mixer - agglomerator like that illustrated in the drawing. However, other agglomeration equipment capable of similar operations can be used, too. One process that has been found to be especially successful is to mix the desired weights of the detergent composition beads and finely divided bentonite powder and then, while still mixing, spray a dilute sodium silicate solution onto the moving surfaces thereof. In some situations other binders, such as gums, resins and surface active agents, may be used or may be present with the silicate, or the silicate may be omitted (the silicate in the spray dried beads may act as the binder for the bentonite) but the binding effects are not as good when the silicate is omitted from the spray. The sprayings may be at room temperature but elevated temperatures may also be employed, and spraying will be gradual enough so as to prevent any objectionable lumping of the mixture. Spray temperature ranges may be from 10° to 40° C., and preferably are from 20° to 30° C. Mixing will continue in the drum after the application of the spray, and the bentonite powder will be held to the detergent beads, after which the product may be removed and screened or otherwise size-classified to be within the desired product size range. While continuous operations are preferred the process may be modified to a batch type in some circumstances.

The silicate solution employed will normally be at a concentration of 2 to 8%, preferably 3 to 7% and more preferably 3 to 6%, e.g., 4% and 5%. Enough will be employed so that on the beads on which it is present the silicate from the spray will constitute from 0.1 to 0.4%, preferably 0.2 to 0.3% of the final product weight. At such application concentrations and amounts satisfactory agglomeration and surface coating are obtained, using the rotary drum or other suitable agglomerating equipment. Also, the moisture sprayed onto the beads is not excessive, usually being about 3 to 6% of the product weight. Allowance can be made for this added moisture by making the detergent composition beads drier by a corresponding amount.

The product resulting is sufficiently firm to be able to withstand handling, packaging and storage without objectionable powdering and loss of the bentonite coating. Also, the silicate concentration is not so high as to inhibit dispersion of the bentonite in the wash water when the product is employed in laundry operations. If desired, a dye may be applied in the liquid spray utilized for agglomeration, so as to color the resulting particles. Normally the dye concentration will be less than 1% of the liquid being sprayed, e.g., 0.01 to 0.1% thereof. Dyes and/or pigments applied in the agglomerating spray cover any off-color due to the bentonite and thereby allow the use of such off-color bentonites as softeners in the present compositions. If it is desired to have the product all colored (and blue is a preferred color), the detergent composition "base" beads may also be colored. Specifically, ultramarine blue pigment may be crutched in with the other components of the spray dried detergent composition and Acilan blue or Polar Brilliant blue (dyes) in the silicate solution may be sprayed onto the surfaces of the agglomerated bentonite particles.

After the bentonite-surfaced beads are produced they may subsequently be mixed with materials to be post-added or such materials may be sprayed onto the bead surfaces. Among such materials are enzyme powders, bleaches and perfumes. Alternatively, some of said materials may be applied to or mixed with the base beads or the bentonite before agglomeration. It is also possible to post-add some of the adjuvants to the detergent beads before application of the bentonite to such beads but such method is not usually practiced. After agglomeration is completed the products may be stored for a curing period of one to twenty-four hours, for example, but usually there will not be any need for such a cure, and the agglomerates may be mixed directly with any adjuvants, unless such was accomplished earlier. The products may then be transported to packaging equipment, and may be packed, cased, stored and/or shipped. The agglomerated beads made are good detergents possessing significant softening properties. They are also free flowing, non-dusting and substantially nonfriable, and possess good bead strengths and abrasion resistance.

The following examples illustrate but do not limit the invention. Unless otherwise indicated all parts are by weight and all temperatures are in °C.

EXAMPLE 1

A crutcher slurry is made comprising 1,009 parts of water, 2,584 parts of a detergent base (about 37% active ingredient and about 20% of sodium sulfate, with the balance being water), 841 parts of sodium silicate ($Na_2O:SiO_2=1:2.4$), 1,315 parts of pentasodium tripolyphosphate, 542 parts of soda ash, 24 parts of sodium sulfate and 293 parts of an aqueous solution of fluorescent brightener, anti-redeposition agent, stabilizer, and other minor components in dilute aqueous solution. Crutching is in a commercial plant detergent crutcher at a temperature of about 55° C. for a period of about ten minutes after addition of all the components, with the solids content of the crutcher mix being adjusted to about 58° C. during the crutching. The crutcher mix is subsequently pumped to a countercurrent spray drying tower wherein it is forced through eight nozzles of the 10/10 type at a temperature of 52° C. under a pressure of about 24 kg./sq. cm. The tower temperatures are: $T_1=410°$ C. and $T_2=120°$ C. The detergent beads produced are at a moisture content of about 7% and the spray rate is about 9,000 kg./hr. The beads made are screened to be in a size range of 10 to 60, U.S. Sieve Series. The beads are white and are of a bulk density of about 0.3 g./ml.

Equipment essentially like that illustrated in FIGS. 1 and 2 is employed to agglomerate finely divided bentonite onto the surfaces of the described spray dried detergent composition beads. To make the desired approximately 20% bentonite product No. 325 sieve, bentonite powder (containing about 5% of moisture) is mixed with the detergent composition beads in a proportion of 76.4 parts of the base beads to 19.2 parts of the bentonite. 3.8 Parts of a 5% sodium silicate solution ($Na_2O:SiO_2=1:2.4$) are sprayed onto the tumbling mixture in the rotary drum agglomerator-mixer, utilizing a spray lance having six nozzles (three are illustrated in the drawing) spaced apart about ½ meter. The spray pressure is about 5 kg./sq. cm., which produces a misty spray in which the individual droplets are of diameters within the range of about 0.1 to 0.5 mm. (weight average). After about eight minutes total mixing in the rotary drum, which is at an angle of about 7°, with about the last third of the drum being free of silicate spray application, the product is continuously removed, after which it is perfumed with 0.2 part of a suitable perfume and has 0.4 part of enzyme powder blended with it. In a variation of the process the enzyme may be blended with the product in the tumbling drum, in the last third thereof, with or without perfume.

The product resulting is an especially useful fabric softening particulate detergent, which may be screened, if desirable, so as to be in the Nos. 10 to 60 range or the 8 to 100 sieve range, as desired. The bulk density of the product is about 0.35 or 0.4 g./ml. and it comprises about 18% of sodium dodecyl benzene sulfonate, 25% of sodium polyphosphate, 9.5% of sodium silicate, 9% of soda ash, 10% of sodium sulfate, 19% of bentonite, 0.4% of enzyme powder, 0.2% of perfume, 0.1% of fluorescent brightener and 9% of water. The detergent beads are free flowing, non-tacky, sufficiently strong for commercial marketing, readily dispersable in wash water and attractive in appearance. In short, the product is an excellent fabric softening heavy duty particulate laundry detergent.

EXAMPLE 2

The procedure of Example 1 is followed except that the silicate solution applied is 3% of sodium silicate and the proportion of solution applied is 4% of the total final product. Flowability, bead strength, non-friability and abrasion resistance are satisfactory, like that of the product of Example 1, and the product is a satisfactory heavy duty fabric softening detergent composition. Similarly, when the same proportion of 6% sodium silicate solution is utilized good results are also obtained. However, when the silicate solution is at 10% concentration the product is unsatisfactory, being lumpy in appearance. When only water is employed as the spray an agglomerate is obtainable but it tends to be higher in fines and generally less satisfactory than those agglomerates which are made using the sodium silicate solution at 2 to 8% concentration. From these experiments and others in which the proportion of spray is varied it is concluded that better products are obtained when the proportion of spray is about 2 to 8% (moisture basis) of the product and the silicate deposited in the spray is from 0.1 to 0.4% of such product.

EXAMPLE 3

The procedure of Example 1 is varied by omitting the soda ash from the crutcher mix and replacing it with sodium sulfate. Also, modifications may be made in the location of the spray nozzles in the agglomerating rotary drum, so that the bentonite and detergent composition beads are mixed in the first quarter of the drum, spraying takes place in the middle half, and subsequent mixing takes place in the end quarter. The product resulting is also a satisfactory fabric softening particulate heavy duty detergent like those of Examples 1 and 2. When a blue dye, such as Polar Brilliant blue, is present at a concentration of 0.2% in the silicate spray solution (or from 0.01 to 0.4%) attractively colored product results. Ultramarine blue and other pigments may be substituted for the dye or may be used with it.

EXAMPLE 4

Changes in the crutcher mix formulations, temperatures, mixing times and mixing procedures are made and different spray drying tower conditions are employed to produce the detergent composition base beads. Variations of ±10% and ±20% are made in the different formula ingredients and in the mixing times, nozzle pressures and other conditions (but such variations are kept within the described ranges) and a good base bead is made, having a bulk density in the range of 0.3 to 0.5. Also, changes are made in the nozzle designs, pressures and silicate concentrations for the spray solutions, as previously described, and so long as the silicate concentration, amount of solution applied and silicate deposited with the bentonite on the base beads are within the ranges previously given good products result. Such is also the case when the concentration of bentonite in the final product agglomerate is varied within the range of 15 to 25%. Also, similar results are obtainable when the detergent beads agglomerated with bentonite are nonionic detergents made by spraying nonionic detergent in liquid state onto base inorganic builder beads, after which agglomeration with bentonite and aqueous sodium silicate solution is effected.

Good products are also obtained when instead of employing the very finely divided bentonite (through No. 325 sieve), such as the Thixo-Jel No. 1 (Mineral Colloid No. 1,001) used for these examples, other bentonites are used, such as those produced by American Colloid Company and those made from European and other bentonites having exchangeable calcium and/or magnesium ions therein converted to sodium ions by sodium carbonate treatment.

The invention has been described with respect to illustrations and examples thereof but is not to be limited to these because it is evident that substitutes and equivalents may be employed without departing from the invention.

What is claimed is:

1. A process for manufacturing a fabric softening particulate synthetic organic detergent composition which comprises mixing together a minor proportion of a finely divided bentonite powder and a major proportion of larger sized detergent composition particles, spraying onto the surfaces of the mixture, while it is in motion, with new surfaces of the mixing materials being continuously presented to the spray, a minor proportion of an aqueous sodium silicate solution at a concentration in the range of 2 to 8% in such quantity that the spray deposits from about 0.1 to 0.4% of sodium silicate and about 2 to 8% of moisture on the mixture, continuing mixing after application of the aqueous sodium silicate solution, and removing agglomerated particulate detergent with bentonite powder held to the surfaces thereof.

2. A process according to claim 1 wherein the bentonite powder is of particle sizes, before agglomeration, such that substantially all of it passes through a No. 200 sieve, U.S. Sieve Series, the detergent composition particles are of sizes, before agglomeration, within the range of Nos. 8 to 100, U.S. Sieve Series, the bentonite is from about 10 to 30% of the fabric softening detergent composition produced, the sodium silicate is of $Na_2O:SiO_2$ ratio in the range of 1:1.6 to 1:3.2 and the concentration of the sodium silicate in the aqueous spray is within the range of 3 to 7%.

3. A process according to claim 2 wherein the bentonite is a swelling bentonite, the detergent composition is a spray dried built synthetic organic detergent composition, the sodium silicate is of $Na_2O:SiO_2$ ratio within the range of 1:2 to 1:3, and the aqueous silicate spray droplets are of weight average diameter no greater than one millimeter.

4. A process according to claim 3 wherein the mixing, spraying, agglomerating and subsequent mixing take place continuously in a rotary drum type mixer.

5. A process according to claim 4 wherein the silicate solution sprayed onto the surfaces of the mixture is a sodium silicate solution of a concentration of 4 to 5% and the silicate thereof which is sprayed onto the mixture constitutes from 0.2 to 0.3% of the final product weight.

6. A process according to claim 5 wherein the $Na_2O:SiO_2$ ratio of the silicate sprayed onto the surfaces of the mixture is about 1:2.4.

* * * * *

UNITED STATES PATENT AND TRADEMARK OFFICE

CERTIFICATE OF CORRECTION

PATENT NO. : 4,699,729

DATED : October 13, 1987

INVENTOR(S) : Richard S. Parr, et al.

It is certified that error appears in the above-identified patent and that said Letters Patent is hereby corrected as shown below:

The term of this patent subsequent to July 2, 2002, has been disclaimed.

Signed and Sealed this

Twenty-sixth Day of January, 1988

*Attest:*

DONALD J. QUIGG

*Attesting Officer*

*Commissioner of Patents and Trademarks*